US005865437A

United States Patent [19]

Moore, Jr.

[11] Patent Number: 5,865,437

[45] Date of Patent: Feb. 2, 1999

[54] CARD GAME

[75] Inventor: Naif Moore, Jr., Mobile, Ala.

[73] Assignee: Gulf Coast Gaming Corporation, Mobile, Ala.

[21] Appl. No.: 845,784

[22] Filed: Apr. 25, 1997

Related U.S. Application Data

[60] Provisional application No. 60/021,073 Jun. 27, 1996.

[51] Int. Cl.[6] ..... A63F 1/00

[52] U.S. Cl. ..... 273/292; 273/303

[58] Field of Search ..... 273/292, 303, 273/304, 305; 463/13, 12, 26, 27

[56] References Cited

U.S. PATENT DOCUMENTS 5,653,444 8/1997 Dahl ..... 273/292 X
5,664,781 9/1997 Feola ..... 273/292

*Primary Examiner*—William E. Stoll

[57] ABSTRACT

A card game as disclosed, wherein winning hands are determined by the four suits that make up a standard deck of 52 playing cards and wherein a winning hand has one card from each suit and further providing a novel way of determining winning hands and providing enhanced pay outs of winning hands, as well as a table structure and video embodiment for playing the same.

11 Claims, 2 Drawing Sheets

CARD GAME

PATENT HISTORY

This patent application is a continuation in part of the Provisional Patent filed Jun. 27, 1996 Provisional Filing No. 60/021,073 By Naif Moore, Jr.

GENERAL DESCRIPTION OF THE PREFERRED EMBODIMENT

The game described herein is a card game utilizing four cards, preferably having four different suits, commonly referred to as diamonds, hearts, clubs and spades.

In the preferred embodiment, the primary steps of obtaining a winning hand is obtaining one card from each separate suit. In the preferred embodiment, each player starts with four cards and then has the option to discard and draw up to three draw cards. In the preferred embodiment, the discard is made by the player and afterwards three common cards are displayed in each of three separate locations corresponding to the first draw, the second draw and the third draw.

In other embodiments, the player (1) would not be restricted to the initial four cards, (2) be allowed to make a hand from the common draw cards, (3) obtain separate draw cards from a deck. While the preferred embodiment envisions a draw without additional wagers, an additional wager could be required before obtaining the draw cards. In the preferred embodiment, no additional wager is required in order to obtain the common draw, and the player can discard as many as three of the four original cards dealt. In other embodiments, the court could be limited to one, two or three draw cards.

These and other objects and advantages of the invention will become better understood hereinafter from a consideration of the specification with reference to the accompanying drawings forming part thereof, and in which like numerals correspond to parts throughout the several views of the invention.

BRIEF DESCRIPTION OF THE DRAWINGS

For a further understanding of the nature and objects of the present invention, reference should be made to the following detailed description taken in conjunction with the accompanying drawings in which like parts are given like reference numerals and wherein.

DETAILED DESCRIPTION OF THE PREFERRED EMBODIMENT

Figure 1:
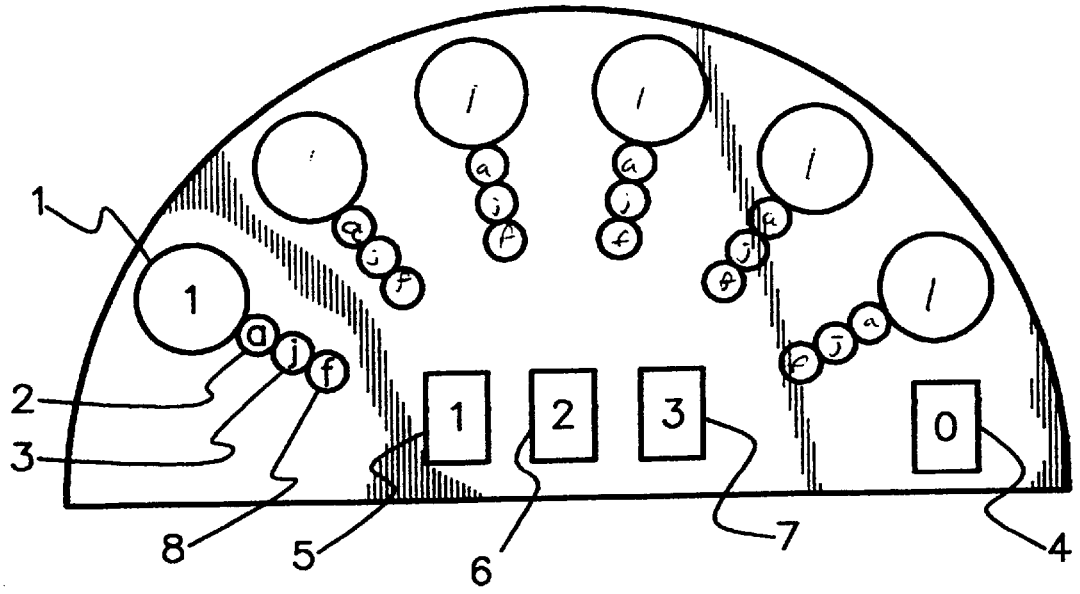
FIG. 1 is a plan view the table showing the playing surface for the game.

In the preferred embodiment, shown on the table in FIG. 1, there are six player locations 1. Each player location has an ante location 2 for an initial wager and a jackpot location 3 for placing bets to participate in higher payouts described below.

The common draw comes from a three or four card hand dealt to the dealer. Where the dealer is dealt four cards, then the dealer discards one of the four cards in the discard location 4. The other three cards which he receives are designated as the first draw, second draw and third draw. The first draw goes on first draw location 5, the second draw on second draw location 6 and the third draw goes to third draw location 7. However, at this point, the draw cards on locations 5–7 are face down.

The players then makes their discards and the discards are collected by the dealer. The player's hands are then disclosed at their respective locations. A player having discarded one card, is only entitled to the first draw card, while the player having discarded two would use the first and second draw card from the dealer and the player who has discarded three cards would use the first, second and third draw cards. Without departing from the concept embodied herein, the dealer could be dealt a fourth draw card to allow players to draw an entirely new hand. In an alternate embodiment, to increase the level of skill, the player's hands could partially or completely be dealt up so that one player could see the hands of the other five players before making a draw decision. Players could be dealt more than four cards (so that, for example, a traditional five card poker hand was held) but at least one card of each suit would still be required.

An additional feature of this game would be to allow or require the player to choose between a high and a low hand of novel composition. All winning hands would have to have the at least one card of each suit, sometime referred herein by the trademark "Rainbow".

In the preferred embodiment, the high winning hand would contain at least one nine card or higher card (with aces being low) from a traditional deck. An alternate embodiment would require the player to make a traditional hand with five cards and could require a pair or better. Another alternate using a four card hand would be to allow a payoff if all cards were of a single suit, also known as a flush, even though this would not be a hand with a card of each suit. This alternate winning combination would be an exception to the general rule, which general rule would require one card of each separate suit.

Where the rules require the player to choose between a high hand and a low hand, (1) the player may be allowed to choose between a high hand and a low hand after seeing the draw cards or (2) the player may be required to make the choice between a high hand and a low hand before seeing the draw cards.

In order to add excitement to the game, an increasing pay out may be made where a better high hand or low hand is obtained in the same manner as in other jackpot type poker. In this way, for example, a four of a kind may have a large pay out where a 9 high 'rainbow' hand (a hand with one card of each suit) may only have an even money (one for one) pay out.

Similarly, a very low hand might have a bonus payout where, for example, the player had the one, two, three and four, all of a different suit. The specific odds on these pay outs would typically be governed by a function of the statistical odds of obtaining the particular hand in question.

All jackpot wagers would require the players place a wager on the jackpot location 3 in the preferred embodiment. The flush hand might require an additional wager on a separate flush location 8 shown in FIG. 1 to receive a flush payout.

An example of a list of the possible high hands and low hands (having one card of each suit) follows with the hands listed in order from highest payout to lowest payout:

All High hands must contain one card of each of the four suits and:
- 4 of a kind highest payout for high,
- 3 of a kind second highest payout,
- two pair third highest payout,
- one pair fourth highest payout,
- any hand 9 or higher without a pair or better being the lowest payout (e.g. even money or 3 to 2 in the preferred embodiment).

All low hands must contain one card of each of the four suits and:

a 4 high, having the highest payout, where four is highest card so that the cards are, necessarily the 1,2,3 and 4 of four different suits;

5 high having the second highest payout;

6 high third highest payout;

7 high forth highest payout, 8 high fifth highest payout (even money in the preferred embodiment-or 3/2).

Finally there is a provision for a non-Rainbow winning hand which may still have a payout, the flush.

The exact pay outs would vary, depending on the statistical pay out desired by the casino host.

An alternate method of determining winning hands and their relative payouts would be to base the payout on the total value of the cards added together. For example, if all face cards were treated as having a value of 10 (the traditional valuation), then a ten, a queen, a nine and a king would total 39. Similarly, in this valuation, a statistically improbable hand (still containing one card of each suit) would be four of a kind. The lowest possible hand in value would be four aces if aces were low. This lowest possible hand would have a value of four. If pairs were treated differently, the lowest possible total would be the ace, two, three and four (for a total of 10) with one card being from each separate suit.

If jacks were treated as eleven, queens as twelve, kings as thirteen, and aces as high or low, than totaling high cards could also lead to statistically remote outcomes. For example, the ace, king, queen and jack (for a total of 50 if aces were treated as having a value of 14, for a total could be made based on this total.

The game as it's played, in the preferred embodiment, would involve the following steps:

The dealer would deal a hand to each player location where a player was located or, in the preferred embodiment, to all six locations. Each of these hands would be a four-card hand. Both the dealer and player hands would be dealt in private to each player in the low skill version. It an alternate embodiment, the cards, other than the draw cards, would be dealt face up to each player in the high skill version.

The dealer would deal himself at least three draw cards. To add excitement, in the preferred embodiment, the dealer would take three cards and a discard card so that his deal would be the same as the deal to the players. The players would then have an opportunity to view their cards in order to determine how many cards they wanted to draw.

In the preferred embodiment, all the players use the same draw cards, up to three. In alternate embodiments, the players could be dealt individual draw cards with awareness that the number of draw cards dealt must be less than the cards remaining in the deck. The game is played with a standard deck of cards, 52 playing cards, four suits (diamonds, hearts, spades and clubs), cards numbered ace through 10, jack, queen and king.

In the preferred embodiment, after the players had made their discards, the cards would be gathered up and the dealer would make his discard from his top card. The remaining three cards would be put with the first card going on the first draw card location in front of the dealer, the second draw card going in the second draw card location in front of the dealer and the third card going into the third draw location in front of the dealer. The cards could be dealt manually or by electronic generation (as in a video game).

This game could be played with a shoe or with a deck of cards, although in the preferred embodiment it is believed that it would be played with a single deck of cards. If the cards were dealt out of a shoe, the three draw cards could actually be drawn from the shoe after the discards were made and placed on the appropriate locations as they are drawn out of the shoe and if they were dealt out of a hand, they could be dealt out of the dealer's hand at this time. In order to build excitement, in the preferred embodiment, the draw cards are dealt ahead of time and put on the draw card locations ahead of time, so that the players are able to view the backs but not the values of the draw cards while making their decision as to what to discard.

After the players have made their decision and the discards have been gathered by the dealer, the hands are turned up to see the value of the hand and determine payouts. Prior to this point, in the preferred embodiment, the players are not allowed to show their cards to one another.

At this time the dealer turns up the draw cards. The dealer then, starting at his left and moving across the table, makes the appropriate high hand or low hand with each of the players' hands, utilizing the draw cards which the dealer has to fill out the hand. Where the player has a losing hand, the wager and cards are collected. Where the player has a winning hand, the dealer returns after the other wagers are collected and cards removed and makes a payout, removing the winning hand cards upon making each payout to each player.

Figure 2:
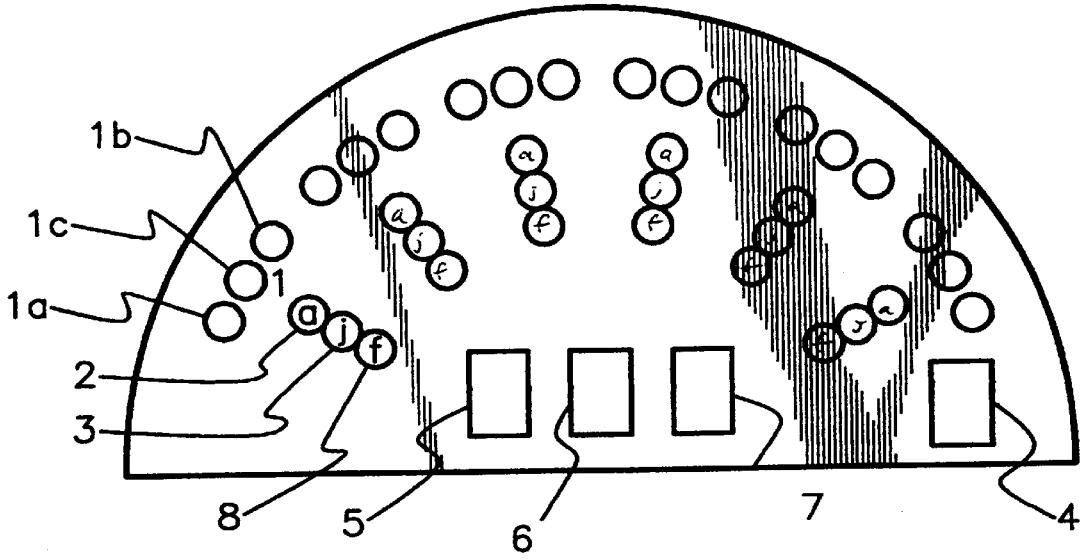
FIG. 2 is a alternate embodiment of the playing surface for the game.

In an alternate embodiment, the players would decide whether they had a high hand or a low hand. As shown in FIG. 2, this would require providing each player with a high location a, a low location 1*b* and an either location 1*c* for either high or low. If the player played against the dealer, this choice may require the player's hand be higher or lower than the dealer's hand. The payout may be greater if the choice is made as compared to merely choosing either. Alternatively, the player's hand could be compared to another player's hand. Obviously, where they are required to pick a high or low hand first, the player would be in a much more difficult playing environment, and in the preferred embodiment, they will be allowed to see the draw cards before making that choice. However, it could be provided that if the player chose between a high hand and a low hand before seeing the draw cards, they would have an enhanced payout. This is not present in the preferred embodiment.

In addition, in another alternate embodiment described in more detail below, the players would have at least one additional card, and they could elect to go high or low or both making up more than one hand.

In one alternative embodiment, the dealer would also have a hand dealt to him which could be used for two purposes:

It could be used as an opening hand, where if he didn't make a high hand or low hand with one card of each different suit, there would be no opening and it could also be used in order to play against the players' hands.

Where the dealer is playing against the players, cards without a complete rainbow could compete against one another. In one alternate embodiment, all four card rainbow hands (one card of each suit) would win over all three card (three suits in the hand out of the total of four suits) and all three card hands would win over two card hands (two suits in the hand out of the total of four suits).

In the preferred embodiment, the players are just playing to make the hand which they hold and they are not playing against the dealer and the only purpose of the cards before the dealer are to act as draw cards for the players.

Each player is paid if his hand is a winning hand and the proper wager has been made or his wager is collected as is appropriate.

While the four card poker game described, is the preferred method of playing the game, an alternate embodiment would be to have each player and the dealer each receive seven cards with which to make a two-card high hand and the best low hand possible, using traditional poker rules with the controlling factor for the high hand being that it must contain one card of each suit. In the preferred embodiment it would be a four card poker hand, but as can be seen, as long as there was one card of each suit, you could have a five-card poker hand and could even have a game where a fifth suit was required. In the preferred embodiment, there are only the four traditional card suits and the fifth card necessary for traditional poker is not required. High hand is won by the dealer in the preferred embodiment.

While this alternate embodiment concentrates on the high hand, the alternate embodiment, provides that the high hand be a two-card hand and concentrates on the low hand made up of four cards in a rainbow (a rainbow being one card of each different suit).

This game would be much tougher to win, but since seven cards are available to the player it could be made possible.

In this embodiment, the player might be required to win either the high hand, the low hand, or both in order to receive a pay out or may receive a payout for each hand made.

The highest hand in this second scenario, utilizing a two-card high hand and a four-card low hand rated from highest to lowest would be:

1. ace, two, three, four of different suits plus a pair of aces;
2. ace, two, three, four of different suits with any pair;
3. ace, two, three, four each of different suits without any pair.

A slot machine is envisioned which would utilize reels or video to display the player's four cards and allow a pay out whenever four cards of different suits were shown according to the rules described herein, with or without draw cards.

Because many varying and different embodiments may be made within the scope of the inventive concept herein taught and because many modifications may be made in the embodiment(s) herein detailed in accordance with the descriptive requirements of the law, it is to be understood that the details herein are to be interpreted as illustrative and not in a limiting sense.

I claim:

1. A method of playing a game utilizing a card means comprising a plurality of cards and wherein said plurality of cards is comprised of at least two separate suits comprising the steps of:

a) generating at least one player hand to be held by a player said hand having at least one card for each of at least two suits;

b) defining at least one winning hand comprising the at least one player hand containing at least one card of each of the at least two separate suits;

c) providing at least one payout for the at least one winning hand and wherein the at least one player hand comprises four cards and wherein the payoff increases according to the statistical difficulty in making the at least one player hand and wherein the at least one player hand having a eight or less as the highest card and no poker hand equal to a pair or better is treated as a low winning hand.

2. A method of playing a game utilizing a card means comprising a plurality of cards and wherein said plurality of cards is comprised of at least two separate suits comprising the steps of:

d) generating at least one player hand to be held by a player said hand having at least one card for each of at least two suits;

b) defining at least one winning hand comprising the at least one player hand containing at least one card of each of the at least two separate suits;

c) providing at least one payout for the at least one winning hand and wherein the at least one player hand comprises four cards and wherein the payoff increases according to the statistical difficulty in making the at least one player hand and wherein the at least one winning hand further comprises a plurality of high winning hands and plurality of low winning hands and wherein there is a target number within the range of numbers represented on the cards and wherein the plurality of high winning hands further comprises the hands containing a card having a value higher than the target number and wherein the plurality of low winning hands includes those hands which do not have a card of value above the target number and further do not contain a poker type hand from a group chosen from the group of poker hands consisting of a pair, two pair, three of a kind, a straight, and four of a kind.

3. A method of playing a game utilizing a card means comprising a plurality of cards and wherein said plurality of cards is comprised of at least two separate suits comprising the steps of:

d) generating at least one player hand to be held by a player said hand having at least one card for each of at least two suits;

b) defining at least one winning hand comprising the at least one player hand containing at least one card of each of the at least two separate suits;

c) providing at least one payout for the at least one winning hand and wherein the at least one player hand comprises four cards and wherein the payoff increases according to the statistical difficulty in making the at least one player hand and wherein the target number is eight and wherein the plurality of low winning hands have corresponding pay outs varying from highest to lowest according to the following formula:

a four high, having the highest payout, where four is highest card so that the cards are, necessarily the one, two, three and four of the four different suits;

five high having the second highest payout;

six high third highest payout;

seven high forth highest payout;

eight high fifth highest payout.

4. A method of playing a game utilizing a card means comprising a plurality of cards and wherein said plurality of cards is comprised of at least two separate suits comprising the steps of:

a) generating at least one player hand to be held by a player said hand having at least one card for each of at least two suits;

b) defining at least one winning hand comprising the at least one player hand containing at least one card of each of the at least two separate suits;

c) providing at least one payout for the at least one winning hand and wherein the at least one player hand comprises four cards and wherein the payoff increases according to the statistical difficulty in making the at least one player hand and further comprising the step of allowing the at least one player hand to have at least one draw of at least one draw card and further comprising the step of allowing up to three draws from at least three draw cards and wherein there is at least one second card hand and wherein the at least one player hand and at least one second card hand share the same draw cards and wherein there are at least three draw cards, being a first draw card, a second draw card and a third draw card and wherein the draw cards are placed on a designated spot designating which card is the first draw card, which is the second draw card and which is the third draw card.

5. The invention of claim 4 wherein the player must make a wager in order to obtain at least one draw card.

6. The invention of claim 4 wherein the at least one player hand consists of at least one extra card over the number of cards necessary to comprise, in number, one card of every suit and wherein the player is allowed to discard the at least one extra card.

7. The invention of claim 4 wherein a winning hand further requires two cards of at least one suit in the at least one player hand.

8. The invention of claim 4 wherein a system of rating hands, such as traditional poker hands, is present and wherein the winning hand is compared to a dealer hand in order to determine if the winning hand receives the payout, based on winning hand being superior in value to the dealer hand according to the system of rating hands.

9. The invention of claim 4 wherein the game further comprises basing the amount of the payout on the statistical probability of achieving a total based on values assigned to the cards in the winning hand with the payout being greater for those hands having a value which was statistically more remote.

10. A method of playing a betting game with at least one fifty two card standard card deck comprising the steps of:

a) allowing a wager that the player will receive one card from every suit on the deal;

b) allowing a wager that the player will receive a jackpot hand consisting of one hand chosen from the group of poker hands consisting of a pair, two pair, three of a kind, a straight and four of a kind on the deal;

c) allowing a wager that the player will receive a card from every suit from at least one draw of a predetermined maximum number of cards;

d) allowing a wager that a jackpot hand chosen from the group of poker hands consisting of a pair, two pair, three of a kind, a straight and four of a kind will be received from the at least one draw;

e) making at least one payout for winning at least one of the wagers made.

11. The invention of claim 10 further comprising the step of increasing the size of the at least one payout based on the statistical difficulty of making the hand.

* * * * *